US008789934B2

(12) United States Patent
Chen et al.

(10) Patent No.: US 8,789,934 B2
(45) Date of Patent: Jul. 29, 2014

(54) REFILLABLE INK TANKS

(75) Inventors: Qiong Chen, Singapore (SG); Richard Lewis, Sant Cugat del Valles (ES); Marcos Arminana Terrasa, Sant Cugat del Valles (ES); Soon Beng Koh, Singapore (SG); Francesc Ros Cerro, Sant Cugat del Valles (ES); Binte Supati Rudyani, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 465 days.

(21) Appl. No.: 12/993,973

(22) PCT Filed: May 22, 2008

(86) PCT No.: PCT/US2008/064452

§ 371 (c)(1),
(2), (4) Date: Feb. 16, 2011

(87) PCT Pub. No.: WO2009/142634

PCT Pub. Date: Nov. 26, 2009

(65) Prior Publication Data

US 2011/0128330 A1 Jun. 2, 2011

(51) Int. Cl.
*B41J 2/175* (2006.01)

(52) U.S. Cl.
CPC ..... *B41J 2/17513* (2013.01); *B41J 2/17553* (2013.01); *B41J 2002/17586* (2013.01)
USPC ..... 347/86

(58) Field of Classification Search
CPC ..... B41J 2/1753; B41J 2002/17586; B41J 2/17513; B41J 2/17553
USPC ..... 347/84–86
See application file for complete search history.

(56) References Cited

U.S. PATENT DOCUMENTS

| | | | | |
|---|---|---|---|---|
| 5,157,421 | A | 10/1992 | Kitahara | |
| 5,450,112 | A * | 9/1995 | Scheffelin | 347/87 |
| 6,017,118 | A * | 1/2000 | Gasvoda et al. | 347/86 |
| 6,276,788 | B1 * | 8/2001 | Hilton | 347/86 |
| 6,286,949 | B1 | 9/2001 | Lewis et al. | |
| 6,746,111 | B2 | 6/2004 | Thielman et al. | |
| 2006/0017788 | A1 * | 1/2006 | Otis et al. | 347/85 |

* cited by examiner

*Primary Examiner* — An Do

(57) ABSTRACT

An ink tank for use in a printer. In one embodiment, an ink tank includes an outer housing that defines an interior space, and an internal ink bag provided within the interior space, the ink bag being configured to be repeatedly be filled with and deliver ink, the ink tank including a metalized layer having a layer of polymeric material on which has been deposited a metal material.

19 Claims, 2 Drawing Sheets

REFILLABLE INK TANKS

BACKGROUND

Currently under development are ink delivery systems that comprise a high volume ink supply that is designed to provide ink to a relatively small ink buffer that, in turn, deliver the ink to a printhead of a printer. In some embodiments of such a system, the ink buffer can comprise two intermediate ink tanks. In such an arrangement, one of the intermediate ink tanks is used to feed the printhead while the other intermediate ink tank is refilled by the high volume ink supply, thereby enabling continuous printing. Needed are ink tanks suitable for such an application.

BRIEF DESCRIPTION OF THE DRAWINGS

The disclosed ink tanks can be better understood with reference to the following drawings. The components in the drawings are not necessarily to scale.

DETAILED DESCRIPTION

Disclosed herein are ink tanks suitable for use in an ink delivery system in which, for example, ink is to be supplied to the ink tank from a high volume ink supply and then delivered to a printhead of a printer from the ink tank. In some embodiments, the ink tank comprises an outer housing that defines an interior space in which is provided an internal ink bag. The ink bag is adapted to receive the ink from the ink supply. Once the ink bag has been filled with ink, a relatively high pressure fluid, such as air, can be delivered to the interior space of the outer housing to exert pressure on the ink bag and cause the ink to flow out from the ink tank. Examples of ink delivery systems in which such ink tanks can be used are described in PCT Patent Application Serial No. US08/63580 , filed May 14, 2008, which is hereby incorporated by reference in its entirety.

Figure 1:
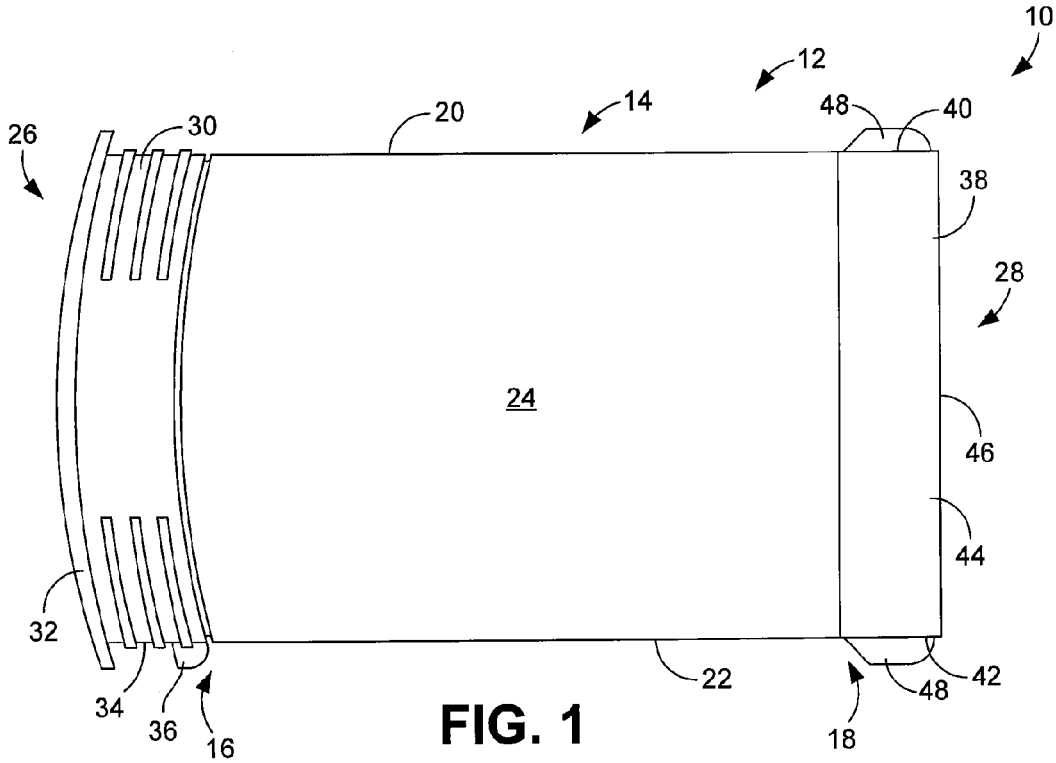
FIG. 1 is side view of an embodiment of an ink tank for use in an ink delivery system.
Figure 2:
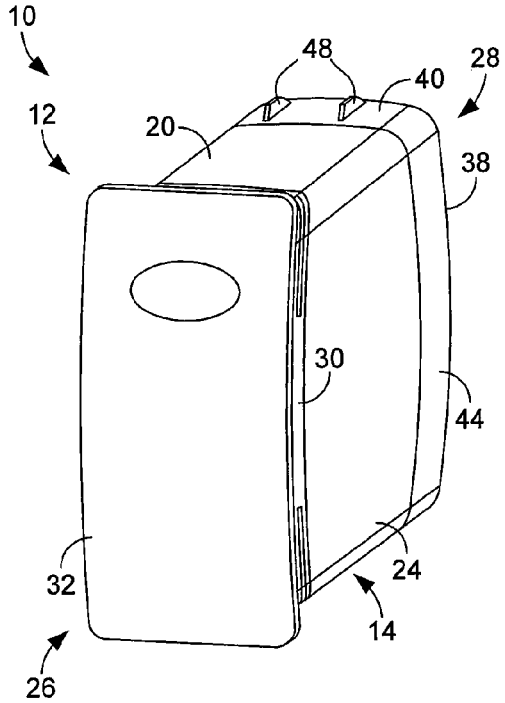
FIG. 2 is a front perspective view of the ink tank of FIG. 1.
Figure 3:
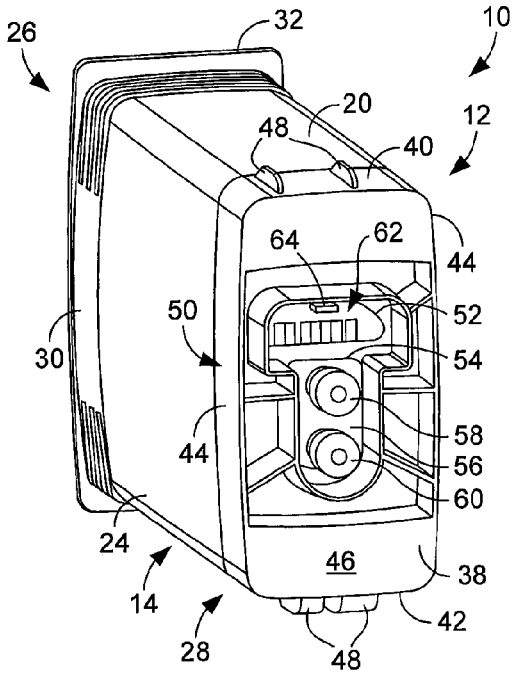
FIG. 3 is a rear perspective view of the ink tank of FIG. 1.

Referring now in more detail to the drawings, in which like numerals identify corresponding parts throughout the views, FIGS. 1-3 illustrate an example ink tank 10. As indicated in those figures, the ink tank 10 comprises an outer housing 12 that includes a central pressure shell 14 having open front and rear ends 16 and 18. As is apparent from FIGS. 2 and 3, the pressure shell 14 has a generally rectangular box shape and therefore defines a top surface 20, a bottom surface 22, and opposed side surfaces 24. By way of example, the pressure shell 14 is constructed of a relatively rigid plastic material that resists flexion when the outer housing 12 is pressurized, as described below.

Respectively coupled to the ends 16, 18 of the pressure shell 14 are a front end cap 26 and a rear end cap 28. The front end cap 26 comprises a body 30 that supports a front panel 32 with which the user can insert the ink tank 10 into a bay of a printer. Extending from a bottom surface 34 of the cap body 30 is a locking element 36 that can be used to secure the ink tank 10 within the bay. The rear end cap 28 also comprises a body 38. The body 38 of the rear end cap 28 includes a top surface 40, a bottom surface 42, opposed side surfaces 44, and an end surface 46. Extending outward from the top and bottom surfaces 40, 42 are keying elements 48 that prevent the ink tank 10 from being inserted into a bay of a printer for which the ink tank is not intended.

As shown in FIG. 3, the body 38 of the rear end cap 28 defines an interface 50 of the ink tank 10 that enables the delivery of ink into and out of the ink tank and further enables detection of ink leakage. In the illustrated embodiment, the interface 50 comprises a first or top opening 52 and a second or bottom opening 54 that provide access to an interior space of the outer housing 12. Visible through the openings 52, 54 in FIG. 3 is an ink bag coupler 56 that is mounted to the end cap 28. Extending out from the coupler 56 and through the bottom opening 54 are an ink port 58 through which ink can flow and an air port 60 through which air can flow. During use of the ink tank 10, ink flows under the force of gravity through a refill line of the printer, through the ink port 58, and into an internal ink bag (see FIG. 4) of the ink tank. When it is determined to deliver ink from the ink tank 10, pressurized air can be pumped through a pressurization line of the printer (not shown), through the air port 60, and into the interior space of the ink tank. As the interior space fills with the pressurized air, the ink bag is squeezed, and ink flows out from the ink bag through the ink port 58 and, therefore, out from the ink tank 10 so that the ink can be routed to a printhead of the printer.

As is further shown in FIG. 3, the ink bag coupler 56 also includes electrical contacts 62. As described below, at least one of those contacts extends into the interior space of the ink tank 10 for the purpose of ink leak detection. Also visible in FIG. 3 is an alignment tab 64 that ensures correct alignment between the coupler 56 and the end cap 28 during manufacturing of the ink tank 10.

Figure 4:
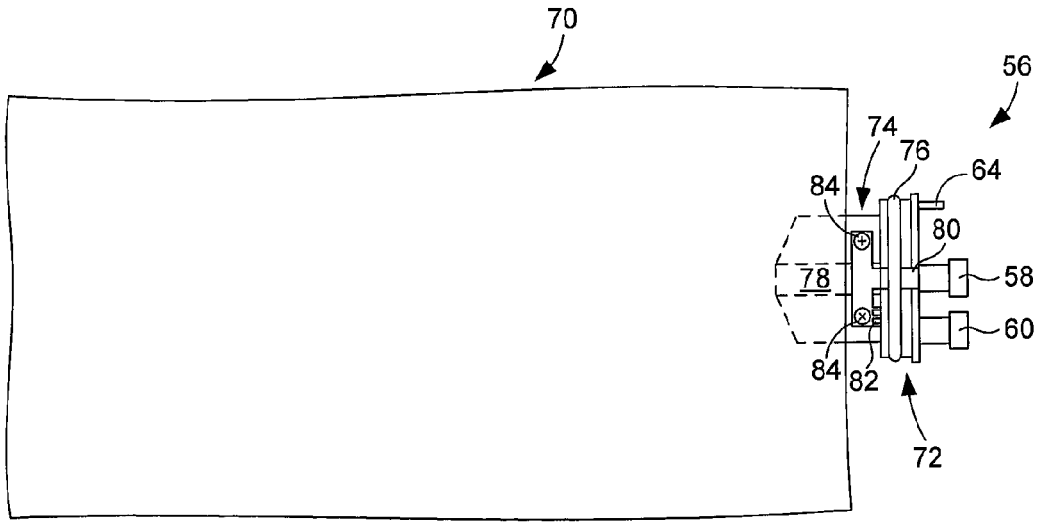
FIG. 4 is side view of an embodiment of an internal ink bag and an ink bag coupler of the ink tank of FIG. 1.

FIG. 4 illustrates an internal ink bag 70 connected to the ink bag coupler 56. As indicated in FIG. 4, the coupler 56 includes an outer interface portion 72 and an inner bag attachment portion 74. By way of example, the interface portion 72 is generally disk shaped and the bag attachment portion 74 is generally planar. In order to facilitate the formation of an airtight seal with end cap 28 of the outer housing 12, the interface portion 72 comprises a sealing member 76, such as a resilient O-ring. The ink bag 70 is attached to the bag attachment portion 74 of the coupler 56. More particularly, the ink bag 70 is sealed to the attachment portion 74 so that fluid can solely pass into and out of the bag through the ink port 58 of the coupler 56, which is in fluid communication with an internal passage 78 of attachment portion.

With further reference to FIG. 4, the coupler 56 also includes an electrical conductor 80 that extends from one or more of the electrical contacts 62 identified in FIG. 3 and wraps around the interface portion 72 of the coupler so as to make contact with one or more inner electrical contacts 82, which are mounted to the coupler attachment portion 72 with fasteners 84. When the inner electrical contacts 76 come into contact with a liquid, such as ink that leaks from the ink bag 70, a short circuit occurs that can be detected by the printer as an indication of bag rupture.

Figure 5:
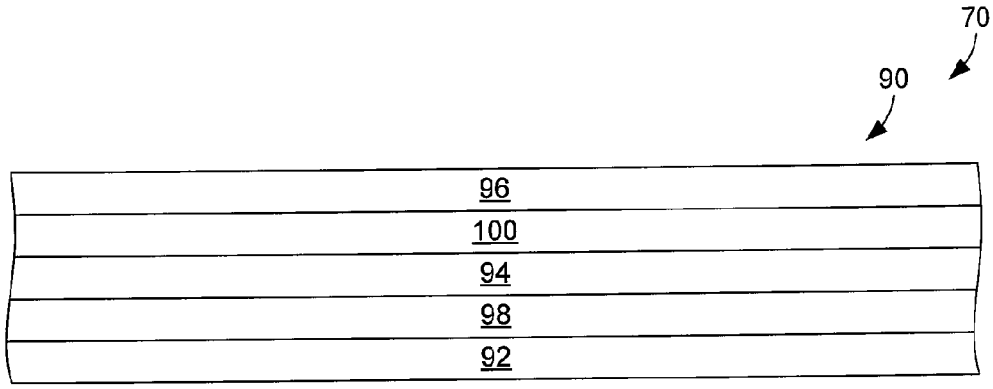
FIG. 5 is a partial cross-sectional view of an embodiment of a wall of the ink bag shown in FIG. 4.

Given that the internal ink bag 70 is intended to be pressurized, emptied, and refilled numerous times during its useful life, the ink bag is constructed for high durability and high resistance to fatigue. FIG. 5 illustrates an example construction for a wall 90 of the internal ink bag 70 shown in FIG. 4. As indicated in FIG. 5, the ink bag wall 90 comprise multiple layers, including a polymeric inner layer 92 that forms an inner surface of the wall, a metalized intermediate layer 94, and a polymeric outer layer 96 that forms an outer surface of the wall. Positioned between the inner layer 92 and the intermediate layer 94 is a first adhesive layer 98 that bonds the intermediate layer to the inner layer. In similar manner, positioned between the intermediate layer 94 and the outer layer 96 is a second adhesive layer 100 that bonds the outer layer to the intermediate layer.

The inner layer 92 provides impact resistance and sealing properties to the ink bag 70. In some embodiments, the inner layer 92 comprises a coextrusion having an intermediate layer of polyamide (e.g., Nylon) interposed between two layers of linear low-density polyethelene (LLDPE). The inner layer 92 can have a thickness of approximately 70 to 80 (μm), for example 76 μm.

The metalized intermediate layer 94 provides a barrier for air and water vapor and comprises a polymeric layer of material upon which has been deposited a metal material. In some embodiments, the intermediate layer 94 comprises a layer of polyethylene terephthalate (PET) on which has been deposited a layer of metal, such as silver (Ag) or aluminum (Al). Such a layer can be contrasted with independent metal foils that could otherwise be used to construct the ink bag 70. The intermediate layer 94 can has a thickness of approximately 10 to 14 μm, such as 12 μm, and the metal layer can have a thickness of no more than approximately 900 to 1100 Angstroms (A), such as 1000 A. In such an embodiment, the first adhesive layer 98 provides adhesion between the PET and the LLDPE. The first adhesive layer 98 can be approximately 2 to 3 μm thick, for example 2.5 μm thick.

The outer layer 96 provides impact resistance and toughness to the ink bag 70. In some embodiments, the outer layer is formed from oriented polyamide (e.g., Nylon). The outer layer 96 can have a thickness of approximately 13 to 17 μm, such as 15 μm. In such an embodiment, the second adhesive 100 provides adhesion between the metal (e.g., Ag or Al) and the polyamide. The second adhesive layer 100 can be approximately 2 to 3 μm thick, for example 2.5 μm thick.

When the ink bag 70 has a construction such as that described above in relation to FIG. 5, the ink bag is resistant to fatigue. In particular, the ink bag 70 is less susceptible to cracks that can otherwise form when a metal foil layer is used due to the metalized intermediate layer 94. Therefore, the ink bag is less susceptible to failure from repeated expansion and collapse of the bag during the refilling and ink delivery cycles.

The invention claimed is:

1. An ink tank for use in a printer, the ink tank comprising:

an outer housing that defines an interior space;

an internal ink bag provided within the interior space, the ink bag being configured to be repeatedly filled with and deliver ink, the ink bag comprising a metalized layer including a layer of polymeric material on which has been deposited a metal material; and an ink bag coupler to which the internal ink bag is attached and that is mounted to the outer housing, the ink bag coupler comprising a leak detection mechanism comprising electrical contact extending into the ink bag, and a plurality of second electrical contacts that are normally electrically isolated to one another, the first electrical contact and the second electrical contacts relatively positioned to detectably electrically short upon the ink leaking from the ink bag.

2. The ink tank of claim 1, wherein the outer housing comprises a pressure shell having a front end and a rear end, a front end cap being provided at the front end of the pressure shell and a rear end cap being provided at the rear end of the pressure shell.

3. The ink tank of claim 2, wherein the rear end cap defines an interface of the ink tank, the interface including an ink port through which ink can flow into and out of the internal ink bag and an air port through which air can flow into and out of the interior space.

4. The ink tank of claim 1, wherein the metalized layer comprises a layer of polyethylene terephthalate (PET) upon which has been deposited a metal material.

5. The ink tank of claim 4, wherein the metal material is aluminum.

6. The ink tank of claim 4, wherein the metal material is silver.

7. The ink tank of claim 4, wherein the PET layer is approximately 10 to 14 μm thick.

8. The ink tank of claim 7, wherein the metal material deposited on the PET layer is approximately 900 to 11 00 Angstroms thick.

9. The ink tank of claim 1, wherein the ink bag further comprises an inner layer and an outer layer between which the metalized layer is positioned, the layer of polymeric material of the metalized layer being different than the inner layer and the outer layer.

10. The ink tank of claim 9, wherein the inner layer and outer layer are formed from polymeric materials.

11. The ink tank of claim 1, wherein the ink bag coupler comprises an ink port through which ink can flow into and out of the internal ink bag and an air port through which air can flow into and out of the interior space.

12. The ink tank of claim 1, wherein the ink bag coupler further comprises:

an outer interface portion having a sealing member to seal the ink tank to the printer upon attachment of the ink tank to the printer; and an inner bag attachment portion to which the ink bag is sealably attached.

13. The ink tank of claim 12, wherein the ink bag coupler further comprises:

an electrical conductor extending from the first electrical contact to the second electrical contacts.

14. The ink tank of claim 13, wherein the electrical conductor wraps around the outer interface portion.

15. The ink tank of claim 12, wherein the ink bag coupler further comprises:

a fastener to mount the second electrical contacts to the outer interface portion.

16. A refillable ink tank for use in a printer, the ink tank comprising:

an outer housing that defines an interior space, the outer housing including a pressure shell and an end cap that defines an interface of the ink tank, the interface including an ink port through which ink can flow into and out of the ink tank and an air port through which air can flow into and out of the interior space;

an internal ink bag provided within the interior space and to be repeatedly be filled with and deliver ink, the ink bag being configured to be repeatedly be filled with and deliver ink, the ink bag comprising multiple layers that are bonded to each other, the multiple layers including a metalized layer comprising a layer of polymeric material on which has been deposited a metal material; and an ink bag coupler to which the internal ink bag is attached and that is mounted to the outer housing, the ink bag coupler comprising a leak detection mechanism comprising electrical contact extending into the ink bag, and a plurality of second electrical contacts that are normally electrically isolated to one another, the first electrical contact and the second electrical contacts relatively positioned to detectably electrically short upon the ink leaking from the ink bag.

17. The ink tank of claim 16, wherein the metalized layer comprises a layer of polyethylene terephthalate (PET) and the metal material comprises aluminum or silver.

18. The ink tank of claim 17, wherein the PET layer is approximately 10 to 14 um thick and the metal material deposited on the PET layer is approximately 900 to 1100 Angstroms thick.

19. The ink tank of claim 16, wherein the multiple layers further include:

an inner layer different than the layer of polymeric material of the metalized layer; and an outer layer different than the layer of polymeric material of the metalized layer, wherein the metalized layer is disposed between the inner layer and the outer layer.

* * * * *

UNITED STATES PATENT AND TRADEMARK OFFICE

CERTIFICATE OF CORRECTION

PATENT NO. : 8,789,934 B2
APPLICATION NO. : 12/993973
DATED : July 29, 2014
INVENTOR(S) : Qiong Chen et al.

It is certified that error appears in the above-identified patent and that said Letters Patent is hereby corrected as shown below:

In the Claims

In column 3, line 55, in Claim 1, delete “electrical” and insert -- a first electrical --, therefor.

In column 4, line 14, in Claim 8, delete “11 00” and insert -- 1100 --, therefor.

In column 4, lines 52-53, in Claim 16, delete “space and to be repeatedly be filled with and deliver ink,” and insert -- space, --, therefor.

In column 4, line 62, in Claim 16, delete “electrical” and insert -- a first electrical --, therefor.

In column 5, line 5, in Claim 18, delete “um” and insert -- μm --, therefor.

Signed and Sealed this
Eleventh Day of November, 2014

Michelle K. Lee

Michelle K. Lee
*Deputy Director of the United States Patent and Trademark Office*